US006614158B1

(12) United States Patent
Thwaites et al.

(10) Patent No.: US 6,614,158 B1
(45) **Date of Patent: *Sep. 2, 2003**

(54) ELECTRON GUN ARRANGEMENTS HAVING CLOSELY SPACED CATHODE AND ELECTRODE AND A VACUUM SEAL

(75) Inventors: Alfred Christopher Thwaites, Maldon (GB); David Ward Carr, Chelmsford (GB); Steven Bardell, Great Dunmow (GB); Peter Robert John Cox, Colchester (GB)

(73) Assignee: EEV Limited, Essex (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/306,811

(22) Filed: May 7, 1999

(30) Foreign Application Priority Data

May 9, 1998 (GB) ..... 9809821

(51) Int. Cl.[7] ..... H01J 29/46

(52) U.S. Cl. ..... 313/446; 313/447; 313/451; 313/456

(58) Field of Search ..... 313/441, 446, 313/447, 452, 456, 458, 409, 414, 417

(56) References Cited

U.S. PATENT DOCUMENTS 3,863,163 A * 1/1975 Farrell et al. ..... 313/455
3,963,955 A * 6/1976 Miram et al. ..... 313/452
3,979,634 A * 9/1976 Jaillet et al. ..... 313/451
3,983,446 A * 9/1976 Miram et al. ..... 313/452
4,341,980 A * 7/1982 Noguchi et al. ..... 313/409
4,480,210 A * 10/1984 Preist et al. ..... 313/293
4,559,468 A * 12/1985 Morrison et al. ..... 313/456
5,134,339 A * 7/1992 Hoffmeister et al. ..... 313/452
5,623,183 A * 4/1997 Allen et al. ..... 313/447
5,903,102 A * 5/1999 Klappert et al. ..... 313/456
5,969,471 A * 10/1999 Ozawa et al. ..... 313/447
5,990,622 A * 11/1999 Schult et al. ..... 313/447
6,133,786 A * 10/2000 Symons ..... 313/447

FOREIGN PATENT DOCUMENTS

GB 2287579 9/1995

* cited by examiner

*Primary Examiner*—Ashok Patel
*Assistant Examiner*—Mariceli Santiago
(74) *Attorney, Agent, or Firm*—Donald C. Casey

(57) ABSTRACT

An electron gun arrangement includes a cathode having a front surface and control grid located in front of it. The control grid is mounted via a cylindrical support on a Kovar mount. The cathode is supported by a cylindrical support mounted on a Kovar support. Ceramic material being located between the two supports. The vacuum envelope within which the electron gun is contained includes the Kovar support and a flexible member with which it makes a vacuum seal, this member being of copper. The copper member is sealed to a ceramic cylinder via metal flanges. The assembly permits the spacing between the cathode and grid to be maintained while the copper member permits thermal expansion to occur to maintain vacuum integrity.

13 Claims, 1 Drawing Sheet

IX
9
10
11
6
14
19
13
12
17
18
16
8
15
5
1
7
3
2
20
4
21
IX 22
23
24

ELECTRON GUN ARRANGEMENTS HAVING CLOSELY SPACED CATHODE AND ELECTRODE AND A VACUUM SEAL

FIELD OF THE INVENTION

This invention relates to electron gun arrangements and more particularly, but not exclusively, to arrangements suitable for use in inductive output tubes (IOTs).

BACKGROUND OF THE INVENTION

In electron gun assemblies used in IOTs and other types of gridded electron beam tubes, it is necessary to be able to accurately space apart the cathode at which the electron beam is generated and the electrode or electrodes located in front of the cathode to control the profile and/or density of the electron beam. The present invention seeks to provides an electron gun arrangement which permits close spacing to be maintained with accuracy between the cathode and adjacent electrode or electrodes and also provides a good mechanical construction.

SUMMARY TO THE INVENTION

According to the invention, there is provided an electron gun arrangement comprising: a vacuum envelope containing a cathode and an electrode located in front of the cathode; an electrode support mounted on a mount of low thermal expansivity; and a flexible member making a vacuum seal with the mount and with a component forming part of the vacuum envelope.

By employing the invention, those aspects of the electron gun arrangement concerned with the electrical part of the assembly and, where the arrangement is to be used in an IOT, the r.f. part of the arrangement are separated from the mechanical, vacuum seal aspect of the design. This permits the electrical and r.f. aspects of the arrangement to be optimized and also the mechanical aspects of the design to be optimized without needing to compromise one with respect to the other. The vacuum envelope is typically formed from several separate sections, some of which may provide support for parts of the electron gun and also provide means for applying electrical potentials to electrodes of the electron gun which are joined together by vacuum seals. In use, the electron gun arrangement becomes hot and components of the vacuum envelope and the gun assembly itself expand to an extent depending on the thermal expansivity of the materials used in the construction. Such an arrangement undergoes a great deal of thermal cycling during its lifetime. In accordance with the invention, a flexible member is included in the arrangement as part of the vacuum envelope to allow for thermal expansion. If all the components making up the vacuum envelope were rigid it is likely that cracks would occur at joints between them and the vacuum is destroyed. The compliance in the vacuum envelope structure afforded by the flexible member permits limited movement between components whilst maintaining vacuum integrity. Such a member need only be sufficiently flexible to enable it to accommodate the expected movement which occurs during thermal cycling and only a small amount of flexibility may be necessary in order to achieve this. Preferably, the flexible mount is of copper although other materials could be used.

As the electrode support is mounted on a mount of low thermal expansivity it ensures that very little movement occurs at the support during thermal cycling. In a preferred embodiment, the mount is of Kovar. Kovar is a U.S. registered trademark No. 337,962 identifying the source of an alloyed metal. The registration is currently owned by CRS Holdings, Inc. of Wilmington, Del. It is thus possible to maintain accurately the predetermined required distance between the electrode and the cathode. The electrode may be a control grid located closely adjacent the front surface of the cathode or could, for example, be a focus electrode. The mount is included as part of the vacuum envelope, making a vacuum seal with the flexible member but is not required to take up any movement due to thermal expansion. Thus there is effectively a decoupling between the electrical and the mechanical considerations of the arrangement. The accuracy requirements for the electrical components can be separated from maintenance of the vacuum envelope. The invention achieves this and yet provides a relatively simple arrangement in which it is not necessary to provide a completely separate structure for mounting the electrodes of the electron bun from the vacuum envelope. Thus the construction is also relatively compact.

The invention is particularly advantageous when it is incorporated in an IOT in which a high frequency resonant cavity surrounds the electron gun and the electrode support forms part of the microwave circuit. Again, the dimensions of this aspect can be optimized to achieve the desired high frequency effect without great concern being paid to how this would affect the integrity of the vacuum envelope.

Use of the invention provides a compact arrangement with a relatively small number of components which nevertheless permits optimization of both electrical/microwave properties of the device and the mechanical aspects.

BRIEF DESCRIPTION OF THE DRAWINGS

One way in which the invention may be performed is now described by way of example with reference to the accompanying drawings in which.

DESCRIPTION OF PREFERRED EMBODIMENTS

Figure 1:
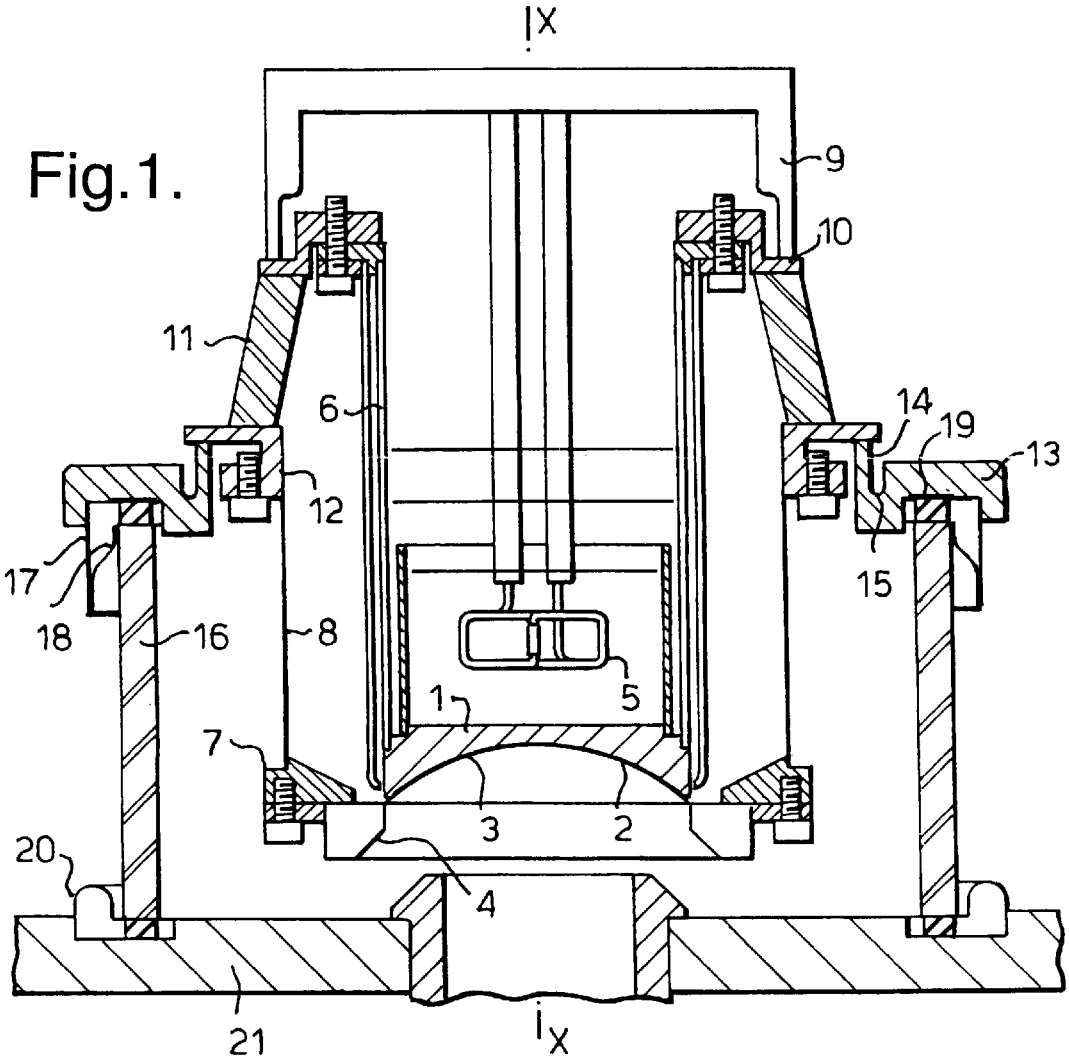
FIG. 1 schematically illustrates an electron gun arrangement in accordance with the invention.

With reference to FIG. 1, an electron gun arrangement comprises a cathode 1 having a curved front surface 2 in front of which is located a curved control grid 3 closely spaced therefrom and conforming to the profile of the cathode front surface 2. An annular focus electrode 4 is located in front of the cathode 2. A heater 5 is located behind the cathode 1 and during use causes the temperature of the cathode 1 to be raised to a temperature sufficiently high for electrons to be emitted from the front surface 2. The cathode 1 is supported by a cylindrical cathode support 6. The control grid 3 and focus electrode 4 are mounted on a common grid mount 7 which is annular and arranged about the cathode 1. The grid mount 7 is supported by a grid mount support 8 which is also cylindrical and coaxially surrounds the cathode support 6.

The electron gun assembly is contained within a vacuum envelope which is partially defined by an end portion 9 which is mounted on a Kovar support 10 to give a vacuum seal therewith, the Kovar support 10 providing a mount for the cylindrical cathode support 6. The Kovar support 10 is in turn brazed to a conical ceramic member 11, the other end of which is brazed to a electrode mount 12 on which the electrode support 8 is fixed at its end which terminates in a flange. The mount 12 is of Kovar and forms part of the vacuum envelope where it is sealed to the adjacent ceramic member 11.

A flexible member 13 of copper is arranged circumferentially about the electrode mount 12. It comprises an annular ring having a portion 14 of reduced width which projects rearwardly in an axial direction and which is sealed by a vacuum joint to the electrode mount 12. A groove 15 surrounds the base of the projection 14 so as to give a relatively long wall of reduced thickness to provide improved flexibility compared to what would be the case if the groove 15 were omitted. The copper flexible member 13 is further joined by a vacuum tight seal to a ceramic cylinder 16 by means of metal flares 17 and 18, a ceramic balance ring 19 being located between the flexible member 13 and the metal flare 18.

The ceramic cylinder 16 is sealed at its other end via a flare arrangement 20 to an end plate 21 which also acts as an anode for the electron gun.

Figure 2:
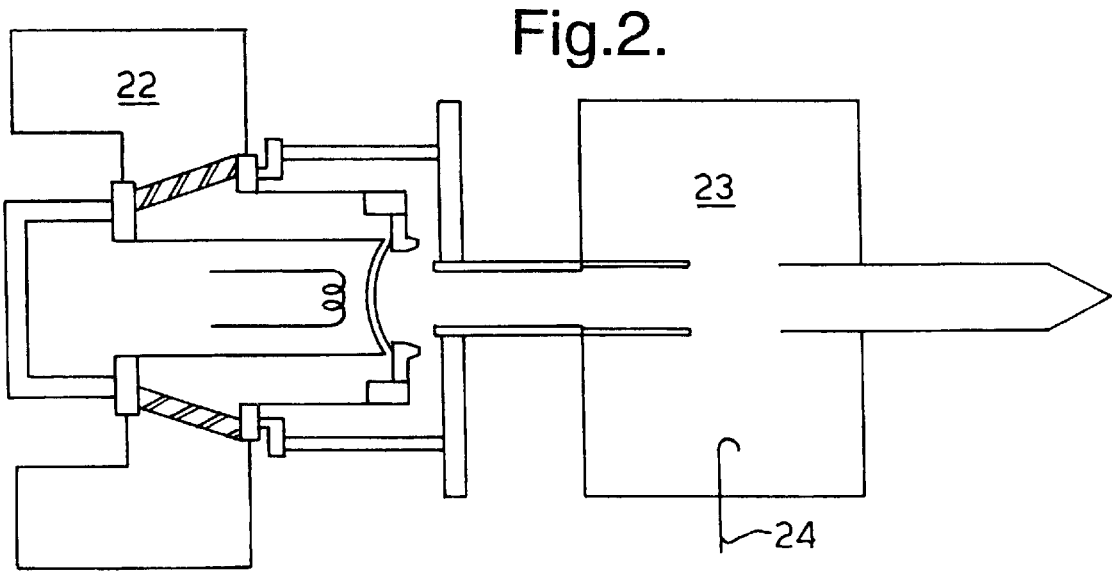
FIG. 2 schematically illustrates an electron beam tube arrangement including the electron gun arrangement of FIG. 1.

The electron gun arrangement is in this embodiment adapted for use in an IOT and the conical ceramic cylinder 11 forms a microwave window via which high frequency input signals are applied to the space between the cathode 1 and grid 3 to cause modulation of the electron beam generated along longitudinal axis X—X. FIG. 2 schematically illustrates the electron gun arrangement of FIG. 1 incorporated in an IOT and shows the input cavity 22 and an output cavity 23 via which an amplified high frequency signal is extracted via a coupling loop arrangement shown at 24.

During use, the electron beam tube becomes hot and various parts of the tube expand to a greater or lesser extent depending on their coefficient of thermal expansion. The cylindrical grid support 8 is mounted on a support 12 of Kovar and the cathode support 6 is mounted on Kovar support 10. As Kovar has a very low coefficient thermal expansion, the spacing between the front surface 2 of the cathode 1 and the control grid 3 remains substantially fixed. The flexible mount 13 of copper, together with to some extent the metal flares 17, 18, and 20 provide the compliance in the vacuum envelope structure to accommodate the changes in dimensions in the structure as a whole.

I claim:

1. An electron gun arrangement comprising: a vacuum envelope containing a cathode and an electrode located in front of the cathode; an electrode support mounted on a mount of low thermal expansivity; and a flexible member making a vacuum seal with the mount and with a component forming part of the vacuum envelope.

2. An arrangement as claimed in claim 1 wherein said flexible member is of copper.

3. An arrangement as claimed in claim 1 wherein said component is a ceramic cylinder.

4. An arrangement as claimed in claim 1 wherein said electrode is a control grid.

5. An arrangement as claimed in claim 1 wherein said electrode support is substantially cylindrical and defines part of a high frequency resonant cavity.

6. An arrangement as claimed in claim 1 wherein said electrode support supports two electrodes.

7. An arrangement as claimed in claim 6 wherein one electrode is a control grid and the other electrode is a focus electrode.

8. An arrangement as claimed in claim 1 wherein said mount is annular and located in axial direction behind a surface of the cathode.

9. An arrangement as claimed in claim 1 wherein said flexible member makes a vacuum seal via a metal flare at one end of said component.

10. An arrangement as claimed in claim 1 wherein said flexible member is substantially annular and located about part of the mount.

11. An arrangement as claimed in claim 1 wherein said flexible member includes an axially extensive projection having a thinner wall than the part of said flexible member making said vacuum seal with said component, said vacuum seal with said mount being made with said projection.

12. An arrangement as claimed in claim 11 wherein a circumferential groove in said flexible member surrounds said projection.

13. An electron beam tube comprising an electron gun arrangement comprising a vacuum envelope containing a cathode and an electrode located in front of the cathode; an electrode support mounted on a mount of low thermal expansivity; and a flexible member making a vacuum seal with the mount and with a component forming part of the vacuum envelope.

* * * * *